US006902431B2

(12) United States Patent
Chen et al.

(10) Patent No.: US 6,902,431 B2
(45) Date of Patent: Jun. 7, 2005

(54) MULTI-FUNCTION CLIP STRUCTURE FOR A WIRELESS ADAPTER

(75) Inventors: Sheng-Chung Chen, Pingtung (TW); Tai-Tung Lien, Miaoli (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/817,657

(22) Filed: Apr. 2, 2004

(65) Prior Publication Data

US 2004/0192419 A1 Sep. 30, 2004

Related U.S. Application Data

(63) Continuation-in-part of application No. 10/162,014, filed on Jun. 3, 2002, now abandoned.

(51) Int. Cl.[7] ..... H01R 13/73
(52) U.S. Cl. ..... 439/574; 439/575
(58) Field of Search ..... 439/574, 575, 439/76; 24/3.12, 3.1, 3.3; 248/316.2, 316.4; 455/351; 224/666–669, 673; 361/399

(56) References Cited

U.S. PATENT DOCUMENTS 3,865,342 A 2/1975 Kanzelberger
5,097,997 A * 3/1992 Kipnis et al. ..... 224/269
5,184,375 A * 2/1993 Hoyt ..... 24/3.12
5,381,922 A 1/1995 Gladman et al.
5,393,235 A 2/1995 Ingalsbe
5,488,759 A * 2/1996 Lim et al. ..... 24/3.12
5,724,747 A 3/1998 Poorman
5,829,102 A * 11/1998 Conti ..... 24/3.12
6,032,337 A 3/2000 Rankin et al.
6,321,418 B1 * 11/2001 Halleck ..... 24/3.12
6,349,126 B2 2/2002 Ogawa et al.
6,598,752 B1 7/2003 Davidov

* cited by examiner

*Primary Examiner*—Alexander Gilman
(74) *Attorney, Agent, or Firm*—Kinney & Lange, P.A.

(57) ABSTRACT

A multi-function clip structure is disclosed and is suitable for use in connecting with a wireless adapter. The multi-function clip structure comprises a main body and a clipping member. After the multi-function clip structure is connected to the wireless adapter, the multi-function clip structure has the multiple functions for placing the wireless adapter steadily on a surface (desktop-type); securing the wireless adapter to a wall by clipping, attaching and hanging (wall-mount type) portable type: being securing the wireless adaptor to a user's belt (portable type); and securing the wireless adaptor to PC peripheral equipments (such as a LCD monitor of a notebook computer).

20 Claims, 3 Drawing Sheets

MULTI-FUNCTION CLIP STRUCTURE FOR A WIRELESS ADAPTER

CROSS-REFERENCE TO RELATED APPLICATION(S)

The present application is a Continuation-In-Part of U.S. application Ser. No. 10/162,014 filed Jun. 3, 2002 abandoned, by S. Chen and T. Lien, entitled "MULTI-FUNCTIONAL CLIP."

INCORPORATION BY REFERENCE

The aforementioned U.S. application Ser. No. 10/1 62,014 is hereby incorporated by reference in its entirety.

FIELD OF THE INVENTION

The present invention relates to a multi-function clip structure, and more particularly, to a multi-function clip structure suitable for use with a wireless adapter.

BACKGROUND OF THE INVENTION

Almost all of the newly purchased personal computers support an interface technology called USB (Universal Serial Bus). The so-called USB interface technology provides the connection between a central processing unit (CPU) and newly-added peripheral elements, thereby automatically configuring the newly-added peripheral elements to the computer. Moreover, the USB interface supports a lot of equipments by the way of serial connection, i.e. first connecting a first equipment to the computer; then connecting a second equipment to the first equipment; and thereafter connecting a third equipment the second equipment; and so on.

Generally, the peripheral hardware can be connected to the computer through the USB interface with a wire (or cable), or wirelessly. For example, some types of mobile phones can communicate with the computer via a wireless USB interface. When the wireless USB interface is used for communication purpose, a wireless adapter has to be used to receive and transmit wireless signals, wherein the computer is connected to the wireless adapter having the wireless USB interface via a wire (cable), and then the wireless USB adapter is used to communicate with the peripheral hardware (such as the mobile phone) wirelessly.

For processing wireless communication with a wireless adapter, it is necessary to place the wireless adapter on an elevated (higher) location or on a location with no barriers so as to obtain better communication effect, and thus the wireless adapter is further designed to a desktop type (which can be placed steadily on a surface) or a wall-mount type (which is secured to a wall) for meeting various user environments. Generally, the wall-mount typed wireless adapter is hung to the wall via a hole formed on the backside of the wireless adapter, but the hole generally ruins the beauty of the product outlook and is disadvantageous to the sales. Further, from the user-friendly points of view, while being applied in the office environments having various types of walls (such as steel wall, wood wall, and concrete wall, etc.), the wireless adapters existing in the current market do not have the features of being attached to those types of walls simultaneously. Moreover, the conventional wireless adaptors cannot be secured to a user's belt or PC peripheral equipments (such as a LCD monitor of a notebook computer, etc.). Accordingly, it is difficult for users to apply the conventional wireless adaptors under all kinds of office environments, thus causing a lot of inconvenience for the users.

On the other hand, in the current market, there are quite a few types of wireless USB adapters, and a pocket-sized wireless adapter is one of the popular adapters. However, having small weight and size, the pocket-sized wireless adapter generally suffers the difficulty of keeping steady on a surface and is easily to be tipped over especially while being connected with a USB cable (which is heavier and bigger). Thus, the pocket-sized wireless adapter is vulnerable while being placed on a desk. Further, it is noted that one of the convenient places for a user to carry the pocket-sized wireless adapter is on the user's belt.

Therefore, from the user-friendly points of view, there is an urgent need to develop a multi-function clip structure for a wireless adapter, whereby the multi-function clip structure not only can be placed steadily on a surface (desk), but also can be simultaneously secured to different types of walls (partitions) by attaching or hanging without forming a hole on the backside of the wireless adapter; and can be secured to a user's belt or PC peripheral equipments by clipping, wherein the wireless adapter can be placed on an elevated (higher) location for better signal reception.

SUMMARY OF THE INVENTION

Just as described above, the conventional wireless adapter has to form a hole on the backside thereof so as to be hung on a wall; cannot be placed steadily on a surface (desk); cannot be secured to the various types of walls by attaching; and can be secured to a user's belt or PC peripheral equipments by clipping.

Hence, an object of the present invention is to provide a multi-function clip structure for a wireless adapter, whereby the wireless adapter can be simultaneously secured to various types of walls by multiple ways including attaching and hanging, so that the wireless adapter can be adapted to all kind of office environments with one single multifunction clip.

Another object of the present invention is to provide a multifunction clip structure for a wireless adapter, whereby the wireless adapter can be hung on a wall without forming a hole on the backside of the wireless adapter, so that the wireless adapter can have a smooth outlook for increasing the market edge.

Another object of the present invention is to provide a multifunction clip structure for a wireless adapter, whereby the pocket-sized wireless adapter can be placed steadily on a desk.

Another object of the present invention is to provide a multifunction clip structure for a wireless adapter, whereby the wireless adapter can be secured to a user's belt or PC peripheral equipments by clipping, so that one of the functions of the multifunction clip structure is to enable the wireless adapter to be portable (while the wireless adapter is hung on the user's belt); and the other one thereof is to secure the wireless adaptor to any PC peripheral equipments nearby (such as a LCD monitor of a notebook computer).

Another object of the present invention is to provide a multifunction clip structure for a wireless adapter, wherein the material forming the multi-function clip is an elastic material such as plastics, so that no complicated movable mechanism is required, thereby substantially saving the cost of parts.

According to the aforementioned objects of the present invention, the present invention provides a multi-function clip structure suitable for use with a wireless adapter, wherein the multi-function clip structure comprises: a main body; and an clipping member having at least one depression structure and a cross-section of such as L-shape, wherein one side of the clipping member is connected to the main body and the other side of the clipping member is able to extend outwards because of the elasticity of the clipping member. Moreover, the present invention also comprises at least two attaching elements placed in the depression structure and installed on the clipping member. Furthermore, after the attaching elements are placed in the depression structure, there is a bridge gap existing in the depression structure, so that the wireless adapter can be hung on nail of a wall via the bridge gap.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein.

DETAILED DESCRIPTION OF THE PREFERRED EMBODIMENT

The multi-function clip structure of the present invention is suitable for use in connecting to a wireless adapter (such as pocket-sized wireless USB adapter), and have the multiple functions for placing the wireless adapter steadily on a surface (desktop type); securing to a wall (wall-mount type) by attaching hanging; and securing to a target (such as a user's belt or PC peripheral equipments) by clipping. Referring to the 3-D view, the front view, the top view, and the right side view respectively shown from FIG. 1 to FIG. 3, a multi-function clip structure 20 comprises a main body 30 and a clipping member 40. The material forming the main body 30 and the clipping member 40 is elastic material (such as plastics). If the main body 30 and the clipping member 40 both are made of plastics, the main body 30 and the clipping member 40 can be formed in one body without a complicated movable mechanism needed, thereby substantially saving a lot of part cost. The clipping member 40 has to be made of an elastic material in order to be clipped with a target (such as a user's belt; PC peripheral equipments such as a LCD monitor of a notebook computer), although the material of the clipping member 40 is not necessary to be plastics. Moreover, the shape of the main body 30 can be a solid plate in the shape of such as rectangular or any other shape, wherein the shape of the main body 30 can also be formed in a hollow frame, i.e. the hollow frame is formed from a solid plate with an opening penetrating from one surface thereof having the maximum surface area to the other surface.

The function of the multi-function clip structure for securing a wireless adapter to a target (such as a user's belt or PC peripheral equipment) by clipping is explained as follows.

Figure 4:
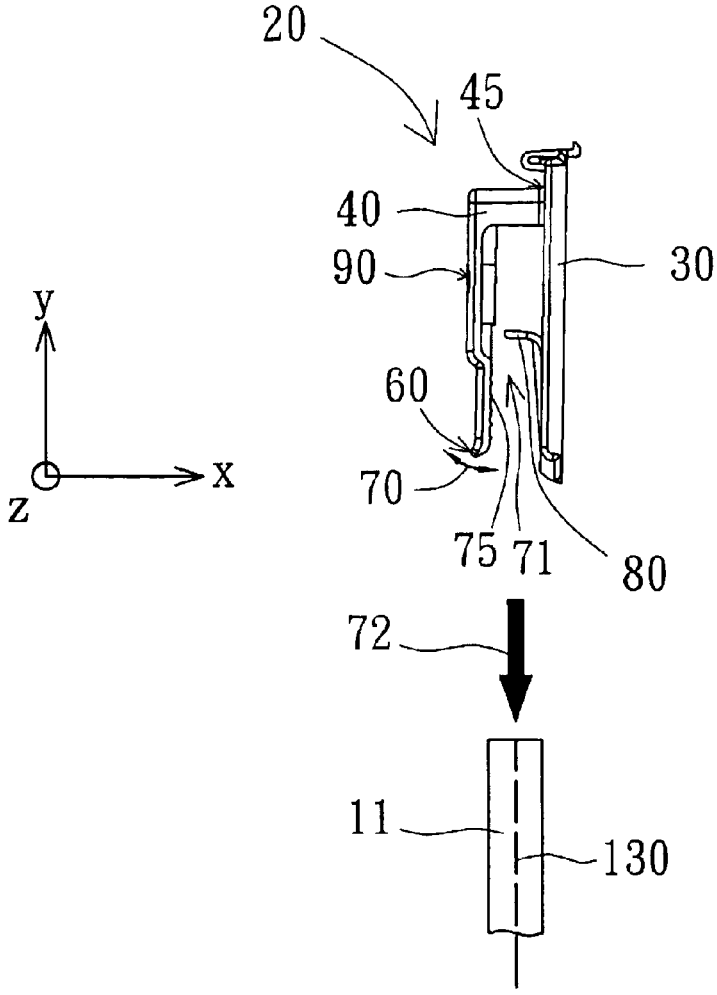
FIG. 4 is a diagram showing the right side view of the multi-function clip structure of the present invention clipped to a target.

Referring to FIG. 4, FIG. 4 is a diagram showing the right side view of the multi-function clip structure of the present invention clipped to a to a target. The clipping member 40 has a substantially L-shaped structure composed of a protrusion portion (not labeled) and an elastic portion (not labeled), wherein the protrusion portion has a first side 45 connected to the main body 30, and the elastic portion has an unrestrained second side 60 opposite to the first side 45. The second side 60 can have a horizontal displacement movement of extending away from or approaching towards the main body 30 in the direction as shown by the arrow 70, due to the elasticity of the clipping member 40. When the multi-function clip structure 20 is moved to a target 11(such as a user's belt or PC peripheral equipments) in the direction as shown by the arrow 72, the top end of the target 11 can be inserted into a space 71 formed between the second side 60 and the main body 30. For increasing elasticity a portion of the elastic portion adjacent to the second side 60 can be further divided into two legs. Thus, even though the width of the top end of the target 11 is a little bit larger than the width of the space 71, the second side 60 still can be extended outwards in the direction of the arrow 70 due to the elasticity of the clipping member 40, so as to clip the target 11 smoothly and tightly. The target 11 indicated herein can be any object to be clipped by the multi-function clip structure 20, such as a user's belt or PC peripheral equipments (such as a LCD monitor of a notebook computer). Moreover, the target 11 is not necessary to be exactly vertical to the x-z horizontal plane. For example, the plane 130 on which the target 11 is located may have some degrees of angle with respect to the y direction, as long as the multi-function clip structure 20 does not slip off while being engaged with the target 11. Besides, a plurality of anti-slip ribs 75 are located on a portion of a surface of the clipping member 40, so that the multi-function clip structure 20 can be clipped to the target 11 more tightly. When the multi-function clip structure 20 is clipped to the target 11, the anti-slip ribs 75 are in contact with the target 11 so as to generation friction. Furthermore, the present invention has a block 80 to limit the depth of the target 11 inserted. The block 80 is installed on the main body 30, and the shape and location of the block 80 is not limited to any specific shape and location provided that the block 80 can perform the limiting function. However, as the location of the block 80 is closer to that of the second side 60, the space 71 is smaller, and the multi-function clip structure 20's clipping force exerted on the target 11 is smaller accordingly. On the contrary, the location of the block 80 is farther from the second side 60 (to the extreme, the vertical portion of the clipping member 40 adjacent to the first side 45 can be used as the block 80), the space 71 is larger and the multi-function clip structure 20's clipping force exerted on the target 11 is bigger accordingly. Therefore, the multi-function clip structure 20 without the block 80 is also within the claimed scope of the present invention. With the clipping mechanism described above, after being connected to a wireless adapter, the multi-function clip structure 20 can effectively secure the wireless adapter to a target (such as a user's belt or PC peripheral equipments) by clipping, wherein the wireless adaptor can be portable while being hung on the user's belt.

On the other hand, the tail of the second side 60 is raised outwards for preventing the target 11 from being damaged while the target 11 is inserted into the space 71. The raising structure of the tail of the second side 60 is particularly suitable for use in various notebook-styled equipments. For preventing the surface of the target 11 from being scratched, the inner surface of the clipping member 40 is further covered with a soft material (such as a rubber pad).

Figure 1:
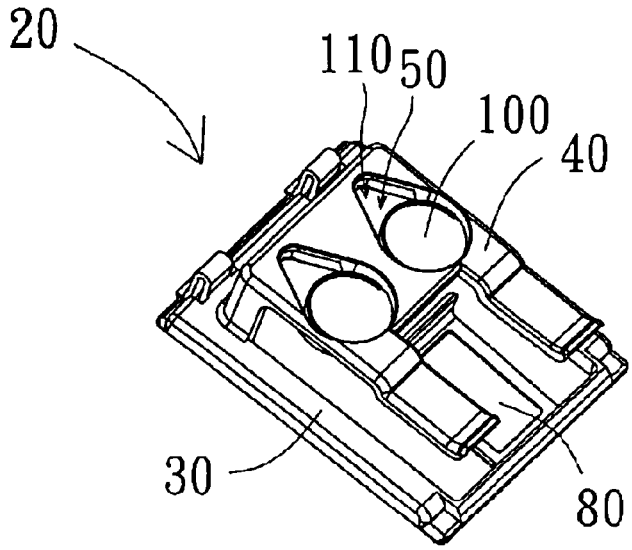
FIG. 1 is a 3-D diagram showing the multi-function clip structure for a wireless adapter according to an embodiment of the present invention.
Figure 2:
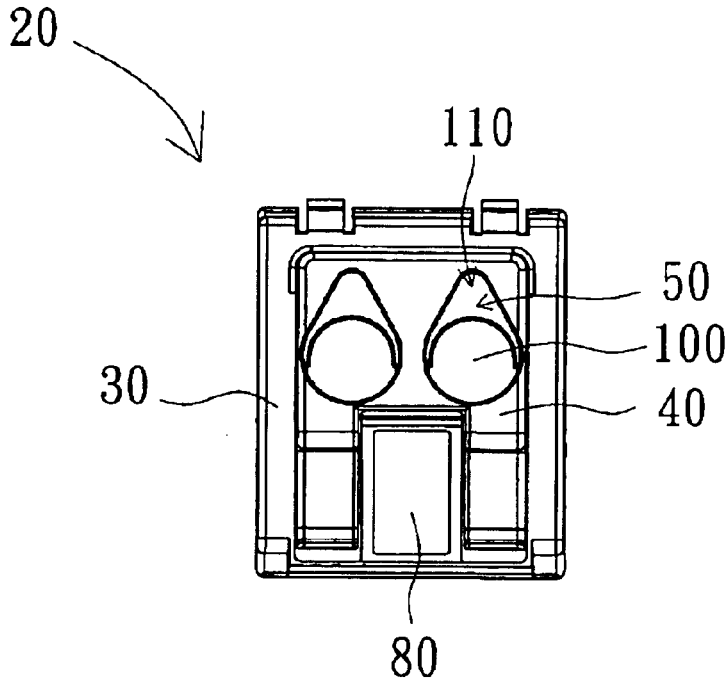
FIG. 2 is a diagram showing the front view of the multi-function clip structure for a wireless adapter according to an embodiment of the present invention.

Hereinafter, referring to FIG. 1 and FIG. 2, the function of the multi-function clip structure for securing a wireless adapter to a wall by hanging or attaching is explained.

Depression structures 50 (such as two depression structures) are formed on the area 90 of the elastic portion adjacent to the protrusion portion of clipping member 40 for securing the multi-function clip structure 20 to a wall by hanging or attaching. The depression structures 50 may be holes completely penetrating through the area 90 of the elastic portion, or merely recessed areas, for being hooked on a protrusive element (such as a nail) installed on a wall, thereby securing the multi-function clip structure 20 to a wall by hanging. For securing the multi-function clip structure 20 to a wall by attaching, at least two attaching elements 100 are placed in the respective depression structures 50. The attaching elements 100 can be such as magnets or mad of Velcro, but the present invention is not limited thereto, as long as the wireless adapter can be attached to the wall (such as the vertical plate) firmly. It is well known that, if the attaching elements 100 are magnets, then the above vertical plate has to be made of the magnet-attachable material (such as steel). Preferably, the height of each of the aforementioned magnets is more than 12 mm, so as to prevent the wireless adaptor from magnetic interference.

It is worthy to be noted that, a bridge gap 110 is an extra space formed on the edge of the depression structure 50 for securing the multi-function clip structure 20 to a wall by hanging and attaching at the same time. After being connected to the multi-function clip structure 20, the wireless adapter can be attached on a wall by installing the attaching elements 100 (such as circular elements) in the depression structures 50; and/or hung on a wall by fitting the bridge gap 110 to a protrusive element (such as a nail) located on the wall, so that the wireless adapter can be secured to a wall by hanging (due to the bridge gap 110) and by attaching (due to the attaching elements 100) simultaneously.

Moreover, the function of the multi-function clip structure for placing a wireless adapter steadily on a surface (desk) is explained as follows.

Figure 3:
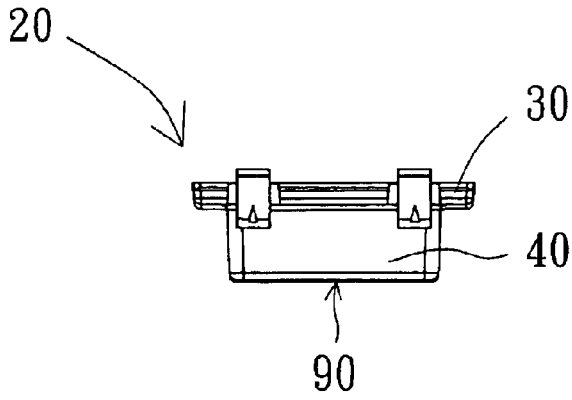
FIG. 3 is a diagram showing the top view of the multi-function-clip structure for a wireless adapter according to an embodiment of the present invention.

Such as shown in FIG. 3, the area 90 of the elastic portion facing downwards has sufficient contact surface to hold the multi-function clip structure steadily on a horizontal surface of an object (such as a desk), so as to achieve the aforementioned desktop type function of the multi-function clip structure. Therefore, the multi-function clip structure 20 can overcome the disadvantage of the pocket-sized wireless USB adapter that is easily to be tipped over and cannot be held steadily when being placed on the desk.

Figure 5:
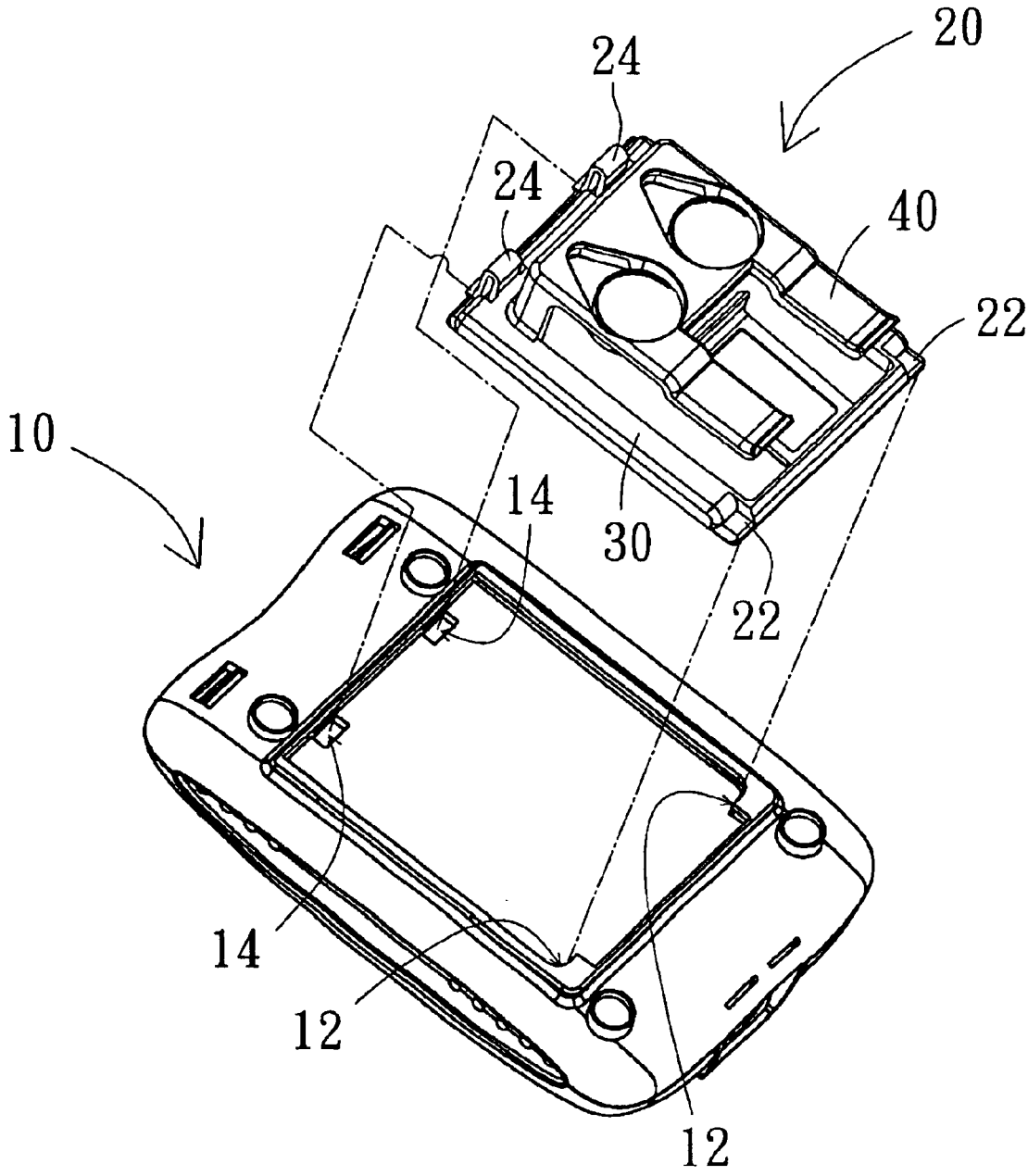
FIG. 5 is a diagram showing the multi-function clip structure of the present invention connected to a pocket-sized wireless USB adapter.

Further, referring to FIG. 5 FIG. 5 is a diagram showing the multi-function clip structure of the present invention connected to a pocket-sized wireless USB adapter. In addition to the main elements described above, slices 22 and hooks 24 are used for combining the multi-function clip structure 20 with the pocket-sized wireless USB adapter 10. The two slices 22 are formed on one end of the main body 30 and the two hooks 24 are on the other end of the main body 30. The slices 22 are engaged with two respective sockets 12 of the pocket-sized wireless USB adapter 10, and the hooks 24 are engaged with two respective cavities 14 of the pocket-sized wireless USB adapter 10. The slices 22, the hooks 24, the sockets 12, and the cavities 14 can be made in any arbitrary shape provided that the multi-function clip structure 20 and the pocket-sized wireless USB adapter 10 can be joined together tightly. After the multi-function clip structure 20 and the pocket-sized wireless USB adapter 10 are joined together as one integrated body, the pocket-sized wireless USB adapter 10 can then be positioned in multiple ways, such as desktop type: being placed on a surface (desk); wall-mount type: being secured to a wall (partition) by attaching or hanging without forming a hole on the pocket-sized wireless USB adapter 10; portable type: being secured to a user's belt; and other types: being secured to PC peripheral equipments (such as a LCD monitor of a notebook computer).

To sum up, one advantage of the present invention is to provide a multi-function clip structure connected to a wireless adapter, whereby the wireless adapter can be placed steadily on the desk, secured to an elevated (higher) location or any proper location by clipping, hanging or attaching.

Another advantage of the present invention is to provide a multi-function clip structure for a wireless adapter, so that the wireless adaptor can be applied in the office environments having various types of walls (such as steel wall, wood wall, and concrete wall, etc.).

Another advantage of the present invention is to provide a multi-function clip structure for a wireless adapter, wherein the material of the multi-function clip is an elastic material such as plastics, so that the complicated movable mechanism is not required, thereby substantially saving the cost of parts.

Another advantage of the present invention is to provide a multi-function clip structure connected to a wireless adapter, so that the wireless adapter can be portable (while the wireless adapter is hung on the user's belt), and be secured to any PC peripheral equipments nearby (such as a LCD monitor of a notebook computer).

As is understood by a person skilled in the art, the foregoing preferred embodiments of the present invention are illustrations of the present invention rather than limitations of the present invention. It is intended to cover various modifications and similar arrangements comprised within the spirit and scope of the appended claims, the scope of which should be accorded the broadest interpretation so as to encompass all such modifications and similar structure.

What is claimed is:

1. A multi-function clip structure, suitable for use with a wireless adapter, wherein said multi-function clip comprises:

a main body, adaptable to a housing of said wireless adapter;

a substantially L-shaped clipping member, composed of a protrusion portion and an elastic portion, wherein a first side of said protrusion portion is connected to said main body, and a second side of said elastic portion is unrestrained, and said second side has a displacement movement of extending away from or approaching towards said main body so as to secure said multi-function clip structure to an object by clipping said object with said elastic portion, said elastic portion having:

at least one depression structure, formed on an area of said elastic portion adjacent to said protrusion portion, wherein said area has sufficient contact surface to hold said multi-function clip structure steadily on a horizontal surface; and a bridge gap, formed on an edge of said depression structure; and at least two attaching elements, installed in said depression structure, wherein said attaching elements are used for securing said multi-function clip structure to a wall by attaching, and said bridge gap is used for securing said multi-function clip structure to said wall by hanging.

2. The multi-function clip structure of claim 1, wherein said main body is connected to said wireless adapter.

3. The multi-function clip structure of claim 1, further comprising:

a plurality of anti-slip ribs, installed on an inner surface of said elastic portion facing said main body, thereby increasing the clipping force between said multi-function clip structure and said object.

4. The multi-function clip structure of claim 1, wherein each of said attaching elements is made of Velcro for attaching said multi-function clip structure clip structure to a Velcro surface.

5. The multi-function clip structure of claim 1, further comprising:

a block, formed on said main body facing said elastic portion for limiting the depth of said object to be inserted.

6. The multi-function clip structure of claim 1, wherein a portion of said elastic portion adjacent to said second side is divided into two legs for increasing elasticity.

7. The multi-function clip structure of claim 1, wherein said object is selected from a group consisting a user's belt, a monitor of notebook computer, and a PC peripheral equipment.

8. The multi-function clip structure of claim 1, wherein the tail of said second side is raised outwards for preventing said object from being damaged.

9. The multi-function clip structure of claim 1, wherein the inner surface of said substantially L-shaped clipping member is covered with a soft material for preventing the surface of said object from being scratched.

10. The multi-function clip structure clip structure of claim 1, wherein said attaching elements are at least two magnets for attaching said multi-function clip structure clip structure on a metallic surface.

11. The multi-function clip structure clip structure of claim 10, wherein the height of each of said magnets is more than 12 mm.

12. A multi-function clip structure, suitable for use with a wireless adapter, wherein said multi-function clip comprises:

a main body, adaptable to a housing of said wireless adapter;

a substantially L-shaped clipping member, composed of a protrusion portion and an elastic portion, wherein a first side of said protrusion portion is connected to said main body, and a second side of said elastic portion is unrestrained, and a portion of said elastic portion adjacent to said second side is divided into two legs for increasing elasticity, and said second side has a displacement movement of extending away from or approaching towards said main body so as to secure said multi-function clip structure to an object by clipping said object with said elastic portion, said elastic portion having:

at least one depression structure, formed on an area of said elastic portion adjacent to said protrusion portion, wherein said area has sufficient contact surface to hold said multi-function clip structure steadily on a horizontal surface; and a bridge gap, formed on an edge of said depression structure;

at least two attaching elements, installed in said depression structure, wherein said attaching elements are used for securing said multi-function clip structure to a wall by attaching, and said bridge gap is used for securing said multi-function clip structure to said wall by hanging; and a block, formed on said main body facing said elastic portion for limiting the depth of said object to be inserted.

13. The multi-function clip structure of claim 12, wherein said main body is connected to said wireless adapter.

14. The multi-function clip structure of claim 12, further comprising:

a plurality of anti-slip ribs, installed on an inner surface of said elastic portion facing said main body, thereby increasing the clipping force between said multi-function clip structure and said object.

15. The multi-function clip structure of claim 12, wherein each of said attaching elements is made of Velcro for attaching said multi-function clip structure clip structure to a Velcro surface.

16. The multi-function clip structure of claim 12, wherein said object is selected from a group consisting a user's belt, a monitor of notebook computer, and a PC peripheral equipment.

17. The multi-function clip structure of claim 12, wherein the tail of said second side is raised outwards for preventing said object from being damaged.

18. The multi-function clip structure of claim 12, wherein the inner surface of said substantially L-shaped clipping member is covered with a soft material for preventing the surface of said object from being scratched.

19. The multi-function clip structure clip structure of claim 12, wherein said attaching elements are at least two magnets for attaching said multi-function clip structure clip structure on a metallic surface.

20. The multi-function clip structure clip structure of claim 19, wherein the height of each of said magnets is more than 12 mm.

* * * * *

UNITED STATES PATENT AND TRADEMARK OFFICE

CERTIFICATE OF CORRECTION

PATENT NO. : 6,902,431 B2
DATED : June 7, 2005
INVENTOR(S) : Sheng-Chung Chen and Tai-Tung Lien It is certified that error appears in the above-identified patent and that said Letters Patent is hereby corrected as shown below:

Column 4,
Line 3, delete “to a to a”, insert -- to a --.

Column 5,
Line 16, delete “mad”, insert -- made --.

Column 8,
Lines 31, 44, 46 and 48, delete “clip structure clip structure”, insert -- clip structure --.

Signed and Sealed this

Twenty-third Day of August, 2005

JON W. DUDAS
*Director of the United States Patent and Trademark Office*